US010843092B2

(12) United States Patent
Hall et al.

(10) Patent No.: US 10,843,092 B2
(45) **Date of Patent: *Nov. 24, 2020**

(54) INTERACTIVE TOWER ATTRACTION SYSTEMS AND METHODS

(71) Applicant: Universal City Studios LLC, Universal City, CA (US)

(72) Inventors: Gregory S. Hall, Orlando, FL (US); Keith Michael McVeen, Winter Garden, FL (US); Michael Tresaugue, Windermere, FL (US)

(73) Assignee: Universal City Studios LLC, Universal City, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/525,158

(22) Filed: Jul. 29, 2019

(65) Prior Publication Data

US 2019/0351342 A1 Nov. 21, 2019

Related U.S. Application Data

(63) Continuation of application No. 15/878,219, filed on Jan. 23, 2018, now Pat. No. 10,369,483.

(51) Int. Cl.
*A63G 31/16* (2006.01)
*A63G 31/02* (2006.01)
(Continued)

(52) U.S. Cl.
CPC ..... *A63G 31/02* (2013.01); *A63G 31/00* (2013.01); *A63G 31/16* (2013.01); *A63G 33/00* (2013.01); *A63G 2031/002* (2013.01)

(58) Field of Classification Search
CPC ..... A63G 31/00; A63G 31/02; A63G 31/04; A63G 31/06; A63G 31/08; A63G 31/10;
(Continued)

(56) References Cited

U.S. PATENT DOCUMENTS 706,891 A 8/1902 Bramhall
1,750,857 A 3/1930 Patterson
(Continued)

FOREIGN PATENT DOCUMENTS

CN 100575645 12/2009
CN 104278858 1/2015
(Continued)

OTHER PUBLICATIONS

Blog at WordPress.com, "The Tech of the Tower of Terror", Website: https:/Jeeyoreandhs.wordpress_com/2011/04/18/the-tech-of-the-tower-of-terror/, Apr. 18, 2011.
(Continued)

*Primary Examiner* — Kien T Nguyen
(74) *Attorney, Agent, or Firm* — Fletcher Yoder P.C.

(57) ABSTRACT

A ride attraction system includes a tower track and a ride vehicle configured to accommodate one or more riders. The ride vehicle is coupled to and configured to move relative to the tower track and the ride vehicle includes one or more user input devices. The ride attraction system further includes an image system configured to display a ride environment, wherein the user input devices are configured to enable the one or more riders to interact with elements of the ride environment via the one or more user input devices. The ride attraction system further includes a controller communicatively coupled to the ride vehicle and the image system and configured to control movement of the ride vehicle relative to the tower track based on signals from the one or more user input devices.

20 Claims, 8 Drawing Sheets

(51) Int. Cl.
*A63G 31/00* (2006.01)
*A63G 33/00* (2006.01)

(58) Field of Classification Search
CPC ..... A63G 31/16; A63B 67/00; H04N 7/00; H04N 7/18
USPC ..... 472/2, 59–61, 130–131; 463/50–53; 434/20–22, 29, 55
See application file for complete search history.

(56) References Cited

U.S. PATENT DOCUMENTS

| | | | | |
|---|---|---|---|---|
| 3,394,505 | A | 7/1968 | Rife | |
| 3,905,166 | A | 9/1975 | Kaiser | |
| 5,628,690 | A | 5/1997 | Spieldiener et al. | |
| 5,765,314 | A | 6/1998 | Giglio | |
| 5,964,666 | A | 10/1999 | Uemura | |
| 6,004,091 | A | 12/1999 | Roth | |
| 6,076,638 | A | 6/2000 | Gertz | |
| 6,126,550 | A | 10/2000 | Moser et al. | |
| 6,128,863 | A | 10/2000 | Millay | |
| 6,220,965 | B1 | 4/2001 | Hanna et al. | |
| 6,280,341 | B1 | 8/2001 | Hayashi | |
| 6,629,895 | B2 | 10/2003 | Uemura et al. | |
| 6,796,908 | B2 | 9/2004 | Weston | |
| 7,614,958 | B2 | 11/2009 | Weston | |
| 7,955,168 | B2 | 6/2011 | Mendelsohn | |
| 7,971,537 | B2 | 7/2011 | Verl | |
| 8,057,317 | B2 | 11/2011 | Roodenburg et al. | |
| 8,206,230 | B2 | 6/2012 | Magpuri | |
| 8,225,555 | B2 | 7/2012 | Magpuri | |
| 8,463,391 | B2 | 6/2013 | Hyde | |
| 8,490,549 | B2 | 7/2013 | Kitchen | |
| 8,491,403 | B2 | 7/2013 | Schreibfeder | |
| 8,578,857 | B2 | 11/2013 | Crawford | |
| 8,992,336 | B2 | 3/2015 | Magpuri | |
| 9,016,210 | B2 | 4/2015 | Kitchen | |
| 9,149,728 | B2 | 10/2015 | Beyr | |
| 9,162,150 | B2 | 10/2015 | Roodenburg et al. | |
| 9,242,181 | B2 | 1/2016 | Vatcher | |
| 9,259,657 | B2 | 2/2016 | Vatcher | |
| 9,266,028 | B2 * | 2/2016 | Alfieri ..... | A63G 31/00 |
| 9,463,379 | B1 | 10/2016 | Brister | |
| 9,463,391 | B2 | 10/2016 | Job | |
| 9,540,832 | B2 | 1/2017 | Magpuri | |
| 9,542,011 | B2 | 1/2017 | Huang et al. | |
| 9,586,151 | B1 | 3/2017 | Boyle | |
| 9,675,894 | B2 | 6/2017 | Vatcher | |
| 9,744,469 | B2 | 8/2017 | Kitchen | |
| 9,827,489 | B2 | 11/2017 | Yale | |
| 9,958,767 | B1 | 5/2018 | Reichow | |
| 2007/0265103 | A1 | 11/2007 | Roodenburg | |
| 2010/0240454 | A1 | 9/2010 | Xiao | |
| 2013/0012327 | A1 | 1/2013 | Schreibfeder | |
| 2013/0059670 | A1 | 3/2013 | Crawford | |
| 2016/0089610 | A1 | 3/2016 | Boyle | |
| 2016/0175720 | A1 | 6/2016 | Vatcher | |
| 2016/0279529 | A1 | 9/2016 | Kitchen | |
| 2017/0225084 | A1 | 8/2017 | Snyder | |
| 2018/0008897 | A1 | 1/2018 | Ackley et al. | |
| 2018/0033199 | A9 | 2/2018 | Eatedali et al. | |
| 2018/0015377 | A1 | 6/2018 | Kitchen | |
| 2018/0253905 | A1 | 9/2018 | McCracken | |
| 2018/0311588 | A1 | 11/2018 | Beumers | |

FOREIGN PATENT DOCUMENTS

| | | |
|---|---|---|
| CN | 104278859 | 1/2015 |
| CN | 104278860 | 1/2015 |
| CN | 104278861 | 1/2015 |
| CN | 104436664 | 3/2015 |
| CN | 204337733 | 5/2015 |
| CN | 204469247 | 7/2015 |
| CN | 105005321 | 10/2015 |
| DE | 19724273 | 12/1998 |
| DE | 19925851 | 4/2001 |
| DE | 202013001239 | 5/2014 |
| WO | 2011042015 | 4/2011 |
| WO | WO2012016416 | 2/2012 |
| WO | 17091076 | 6/2017 |

OTHER PUBLICATIONS

Robert Niles, "Weekly Top 10: The World's Best Drop Rides", Website: http:/Jwww.themeparkinsider.com/fume/201501/4369/, Jan. 12, 2015.

Wikipedia, "The Twilight Zone Tower of Terror", Website: https:l/en.wikipedia.org/wiki/The_Twilight_Zone_Tower_of_Terror, Oct. 10, 2018.

PCT/US2019/012925 Invitation to Pay Additional Fees dated Mar. 27, 2019.

Youtube, "African Jungle Lift" Website: https://www.youtube.com/watch?v=AjoQZU3zVUs (Accessed on Jul. 20, 2017).

Intamin Amusement Rides, "Ultra Tower Multi Drop Tower|Immersive Simulator" Website: https://www.intaminworldwide.com/project/ultra-tower-2/, (Accessed on Jan. 3, 2018).

* cited by examiner

INTERACTIVE TOWER ATTRACTION SYSTEMS AND METHODS

CROSS REFERENCE TO RELATED APPLICATION

This application is a continuation of U.S. patent application Ser. No. 15/878,219, filed Jan. 23, 2018, and entitled "Interactive Tower Attraction Systems and Methods," which is hereby incorporated by reference in its entirety for all purposes.

FIELD OF DISCLOSURE

The present disclosure relates generally to the field of amusement parks. More specifically, embodiments of the present disclosure relate to interactive tower attractions systems and methods.

BACKGROUND

Theme or amusement park ride attractions have become increasingly popular. One type of amusement park attraction may consist of a tower ride that gives a rider the feeling of dropping toward the ground. In such rides, a motion of a passenger vehicle typically consists of a rise to the top of the tower followed by a free-falling motion during a descent. Tower rides may vary from one another with respect to a height of the tower, a configuration of the ride vehicle, and the incorporation of narrative-based effects and scenery (e.g., the surrounding props and audio/visual effects). However, in contrast to other types of rides, it is now recognized that tower rides typically offer fewer opportunities for variable ride experiences. For example, while roller coasters can be configured to incorporate different loops, drops, rises, and turns such that each roller coaster provides a different ride experience, different types of tower rides may provide generally similar ride experiences.

SUMMARY

Certain embodiments commensurate in scope with the originally claimed subject matter are summarized below. These embodiments are not intended to limit the scope of the disclosure, but rather these embodiments are intended only to provide a brief summary of certain disclosed embodiments. Indeed, the present disclosure may encompass a variety of forms that may be similar to or different from the embodiments set forth below.

In accordance with one embodiment, a ride attraction system includes a tower track and a ride vehicle configured to accommodate one or more riders. The ride vehicle is coupled to and configured to move relative to the tower track and the ride vehicle includes one or more user input devices. The ride attraction system further includes an image system configured to display a ride environment, wherein the user input devices are configured to enable the one or more riders to interact with elements of the ride environment via the one or more user input devices. The ride attraction system further includes a controller communicatively coupled to the ride vehicle and the image system and configured to control movement of the ride vehicle relative to the tower track based on signals from the one or more user input devices.

In another embodiment, a ride attraction system includes a tower, a plurality of tower tracks disposed within the tower and extending along vertical walls of the tower, and a plurality of ride vehicles. Each ride vehicle of the plurality of ride vehicles is coupled to a respective tower track of the plurality of tower tracks and configured to move in three or more degrees of freedom relative to the respective tower track of the plurality of tower tracks and independently of other ride vehicles of the plurality of ride vehicles. The ride attraction system further includes at least one user input device associated with each ride vehicle of the plurality of ride vehicles, each user input device configured to receive user inputs and provide user input signals. The ride attraction system further includes a controller configured to receive the user input signals from each user input device and provide instructions to a ride vehicle controller of an individual ride vehicle of the plurality of ride vehicles to initiate a motion pattern of the individual ride vehicle based on the received user input signals.

In another embodiment, a method includes receiving user input signals, at a controller, from user input devices associated with respective ride vehicles of a plurality of ride vehicles, determining, via the controller, a point total of each ride vehicle of the plurality of ride vehicles based on the received user input signals, and triggering, via the controller, one or more motions of an individual ride vehicle of the plurality of ride vehicles independently of other ride vehicles of the plurality of ride vehicles based on the point total accumulated by each ride vehicle of the plurality of ride vehicles.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

The present disclosure is directed to an interactive tower attraction for a theme park or an amusement park. The present techniques provide an interactive tower attraction that facilitates interaction of the riders with the ride environment as well as with each other. For example, user input or user-driven selections may trigger changes in the motion of one or more vehicles and/or the ride effects. In this manner, repeat riders may have different experiences during each ride. In addition, the ride experience may be tied to a ride narrative or a ride goal.

Such interaction with the environment and/or the other riders may permit the riders to affect the motion of other ride vehicles, as well as, in some embodiments, the motion of their own ride vehicle. The interactive tower attraction may include an augmented reality (AR) system, a virtual reality (VR) system, a special effects (SFX) system, and/or a projection system that may provide an immersive environment with which the riders may interact. Further, the AR, VR, and/or projection systems permit interaction of the riders and/or ride vehicles of the interactive tower attraction. Motion of the ride vehicles of the interactive tower attraction may be triggered by the interaction of one or more riders within each ride vehicle with the environment provided by the AR, VR, and/or projection systems. The triggering of certain motions of the ride vehicles may provide experiences that may vary for each ride vehicle during the course of the ride. Interaction of the riders with the ride environment may further trigger other special effects, such as air blasts, cold wind, heat, water spray, smoke, fog, sound, and lighting effects via the SFX system.

Figure 1:
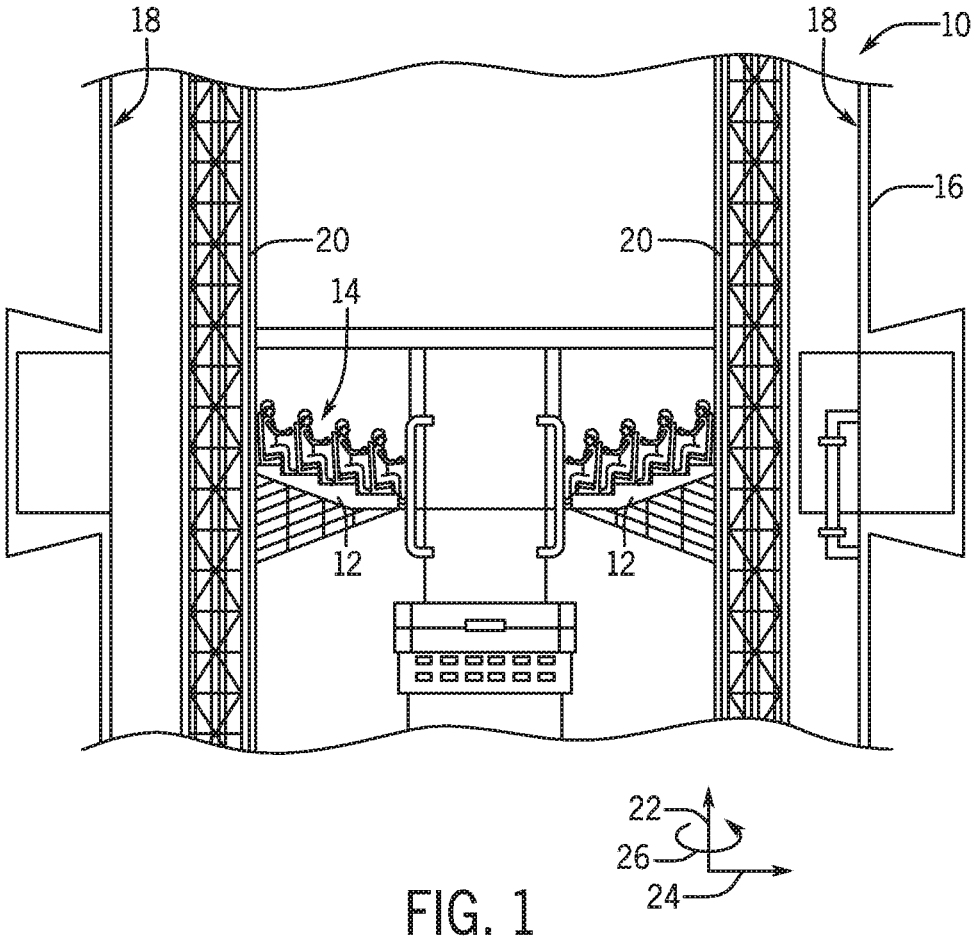
FIG. 1 is a cross-sectional front view of an embodiment of an interactive tower attraction, in accordance with present techniques.

While the present techniques are disclosed in conjunction with a tower ride, other embodiments may involve other attraction types. For example, the interactive gaming type environment as provided herein may be incorporated into attractions, e.g., track-based rides, FIG. 1 is a cross-sectional front view of an embodiment of an interactive tower attraction 10 in accordance with the disclosed techniques that includes at least two ride vehicles 12. The interactive tower attraction 10 may include one or more of the ride vehicles 12 used to hold and carry one or more riders 14 during operation of the ride. The interactive tower attraction 10 includes a tower 16 that supports the ride vehicles and that provides a generally vertical vehicle path along which each vehicle 12 can move up or down. The ride vehicles 12 may be coupled to supports, e.g., each vehicle 12 may be coupled to a corresponding tower track 20. To facilitate discussion, the interactive tower attraction 10 and its components may be described with reference to an axial axis or axial direction 22, a radial axis or radial direction 24, and a circumferential axis or circumferential direction 26.

Each tower track 20 may be disposed adjacent to or within the interior walls 18 of the tower 16 and aligned with the axial axis 22 of the tower 16. While, in certain embodiments, the interactive tower attraction 10 may be implemented with freestanding or exterior tower tracks 20, the interior walls 18 may provide a generally controlled environment to facilitate AR, VR, and/or SFX effects. The tower tracks 20 may be disposed along the tower 16, and each ride vehicle 12 may move along and relative to the corresponding tower track 20. The tower tracks 20 may enable movement of the ride vehicles 12 in the axial direction 22 within the tower 16. Further, the ride vehicles 12 may move in other directions relative to the corresponding tower track 20, as discussed in greater detail with reference to FIG. 3. In operation, each ride vehicle 12 holding one or more riders 14 may move along the corresponding tower track 20 and may move in other directions relative to the corresponding tower track 20 during the duration of the ride. In some embodiments, the tower tracks 20 may include different directional components (e.g., curves). For example, the tower tracks 20 may spiral up and down the tower 16.

In the depicted embodiment, each ride vehicle 12 may be positioned along the corresponding tower track 20 such that the riders 14 within each ride vehicle 12 face away from the corresponding tower track 20 and towards a center 23 and as such the riders 14 of each ride vehicle 12 face in a direction generally toward other riders 14 in opposing and/or adjacent vehicles 12 of the interactive tower attraction 10. This configuration may enable the riders 14 to interact with and affect the experience of the riders 14 of other ride vehicles 12, as discussed in greater detail with reference to FIGS. 4 and 5. In some embodiments, the interactive tower attraction 10 may include one or more screens in the center 23, such that the position of the ride vehicle 12 may enable the riders 14 to face away from the corresponding tower track 20 and toward the one or more screens. In such embodiments, this configuration may enable the riders 14 to interact with the screen and the ride environment. The individual tower tracks 20, each coupled to a corresponding ride vehicle 12, may enable axial movement of the ride vehicles 12 together or individually, and as such, some of the movements of the ride vehicles 12 throughout the duration of the ride may be shared movements (e.g., in which all vehicles move together) and some movements may be individual movements experienced by the riders 14 in only certain ride vehicles 12 and not experience by other ride vehicles 12.

In operation, the ride vehicles 12 accommodating the riders 14 may be raised along the corresponding tower tracks to a particular height within the tower 16. At this starting height, the riders 14 may interact with one another and/or the ride environment, as discussed in greater detail with reference to FIG. 4. Such interaction may enable the riders 14 to affect the movement of the other ride vehicles 12 relative to their respective tower tracks 20 and/or the movement of their own ride vehicle 12 relative to the corresponding tower track 20 to which their ride vehicle 12 is coupled.

Figure 2:
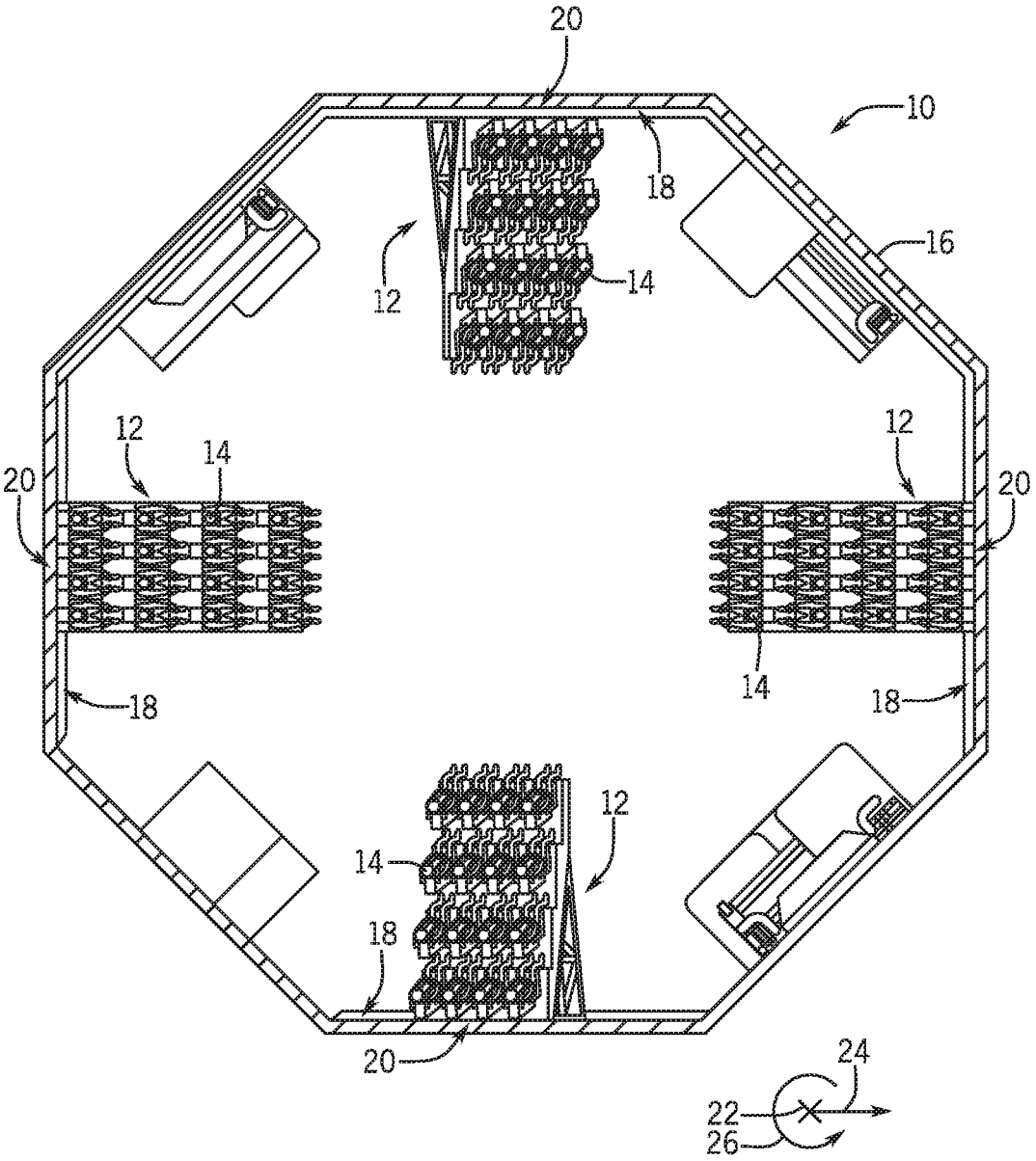
FIG. 2 is a cross-sectional top view of an embodiment of the interactive tower attraction of FIG. 1, in accordance with the present techniques.

FIG. 2 is a cross-sectional top view of an embodiment of the interactive tower attraction 10 illustrating the multiple ride vehicles 12 disposed within the tower 16. In the illustrated embodiment, the tower 16 includes four ride vehicles 12 and four corresponding tower tracks 20 disposed with interior walls configured as an eight-sided space (e.g., eight interior walls 18) forming an octagonal cross-sectional shape. However, in some embodiments, the tower 16 may include any number of walls (e.g., 4, 6, 10, 12) forming various polygonal cross-sectional shapes. In some embodiments, the tower 16 may include one or more curved interior walls 18, for example, the tower 16 may be implemented as a silo or with an annular cross-sectional shape. As previously discussed, the interactive tower attraction 10 may include one or more of the ride vehicles 12 used to hold and carry one or more riders 14 during operation of the ride. Each ride vehicle 12 is coupled to the corresponding tower track 20 and, as such, is coupled to, positioned adjacent to, or at a location within the space formed by the interior walls 18. Further, the number of ride vehicles 12 and corresponding tower tracks 20 may be one, two, or more. In the illustrated embodiment, the ride vehicles 12 may be spaced apart within the interior walls 18. The eight interior walls 18 may hold fewer than eight ride vehicles 12 and corresponding tower tracks 20.

Figure 3:
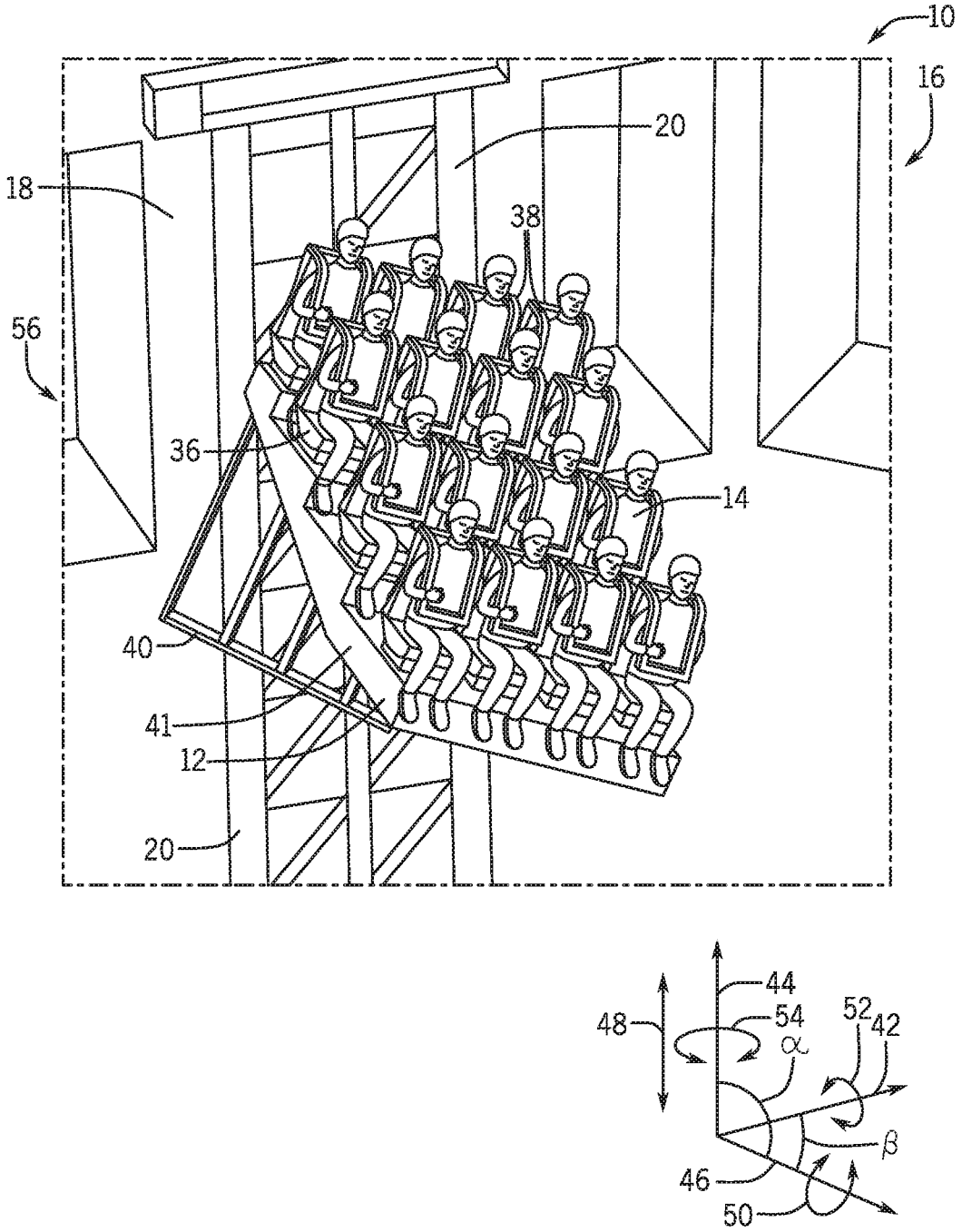
FIG. 3 is a perspective view of an embodiment of a ride vehicle of the interactive tower attraction of FIG. 1, in accordance with the present techniques.

FIG. 3 is a perspective view of an embodiment of the ride vehicle 12 of the interactive tower attraction 10. As discussed, each ride vehicle 12 may hold and carry one or more riders 14, and may move relative to its respective tower track 20 during operation of the interactive tower attraction 10. In some embodiments, the ride vehicle 12 may move in multiple degrees of freedom relative to its respective tower track 20, as discussed in detail herein. Further, the ride vehicle 12 may include a seat 36 and a harness, support, or set of straps 38 for each rider 14. As in the illustrated embodiment, in ride vehicles 12 made for more than one rider 14, the seats 36 may be slanted or arranged to elevate the rear seats such that each rider 14 may be able to fully visualize the ride and interaction area forward of the ride vehicle 12.

In some embodiments, each ride vehicle 12 may include a support frame 40 and a stepped platform 41, which may be coupled to the top of the support frame 40. The support frame 40 may be coupled to the corresponding tower track 20. Movement of the support frame 40 via a control system may enable movement of the ride vehicle 12 and the riders 14 relative to the tower track 20. The control system may cause the ride vehicle 12 to move in multiple degrees of freedom relative to the tower track 20. In some embodiments, such motion may include axial motion along the tower track 20 including controlled and free fall motion. Motion of the ride vehicle 12 may further include such movement as pitch, yaw, and roll, either alone or in combination with one another. To facilitate discussion of the movement and degrees of freedom of such movement of the ride vehicle 12, movement of the ride vehicle 12 may be described with reference to an x axis 42, a Y axis 44, and a Z axis 46 of the ride vehicle 12. The Y axis 44 is an axis of the ride vehicle 12 that is parallel to the axial axis 22 of the tower 16 and the tower track 20. The X axis 42 is an axis perpendicular the to the Y axis 44 and perpendicular to the axial axis 22 and the tower track 20. The Z axis 46 is an axis coming out of the interior wall 18 toward the center of the tower 16 in the direction that the ride vehicle 12 extends into the interior of the tower 16. Further, the movement of the ride vehicle 12 relative to the tower track 20 may be described with reference to an angle $\alpha$ between the Y axis 44 and the Z axis 46, and an angle $\beta$ between the X axis 42 and the Z axis 46.

Each ride vehicle 12 may move in two or more degrees of freedom (e.g., 2, 3, 4) relative to the corresponding tower track 20, as discussed in greater detail below. Each ride vehicle 12 may move in a direction 48 vertically up and down along, for example, relative to, the corresponding tower track 20. This movement may be parallel to the tower track 20, the interior wall 18, and the axial axis 22. This motion may, in some embodiments, be a controlled rise or fall of the ride vehicle 12 along the tower track controlled via the control system. In some embodiments, motion along the tower track 20 and the Y axis 44 may include a free fall (e.g., an uncontrolled fall) motion, such that speed of the fall is not controlled creating a feeling of being dropped or falling toward the ground. One or more motions as provided herein of the ride vehicle 12 executed in sequence or in parallel may be referred to as a motion pattern. A motion pattern may be initiated in response to user-driven ride events, as provided herein. Further, an individual motion pattern may be applied to only one ride vehicle 12 of the plurality of ride vehicles 12 within the attraction 10.

Motion in the direction 48 along the tower track 20 may be used at the beginning of the ride to lift the ride vehicles 12 and the riders 14 from the ground to a starting height or starting position 56 of the ride within the tower 16. Motion in the direction 48 along the tower track 20, either controlled, free fall, or both, may occur during the duration of the ride as the riders 14 interact with the other ride vehicles 12 and/or the ride environment. In some embodiments, the ride vehicle 12 may move up and down from the starting position 56 along the tower track 20 during the duration of ride. In such embodiments, the starting position 56 may be near the top of the tower 16 and/or near the top of the tower track 20. However, in some embodiments, the ride vehicle 12 may only be raised along the tower track 20 to position the ride vehicle 12 in the starting position 56 or to return the ride vehicle 12 to the starting positon 56 after a controlled or free fall during the duration of the ride. In such embodiments, the starting position 56 may be a distance away from the top of the tower 16 and/or the top of the tower track 20 such that the ride vehicle 12 may move upward from the starting position 56 during the ride. Further, such motion 48 along the tower track 20 during the duration of the ride may be triggered by interaction of the riders 14 of the ride vehicle 12 with other ride vehicles 12 and/or the ride environment, as discussed in greater detail with reference to FIGS. 5 and 6, and/or such motion 48 may be programmed to occur through the control system.

Further, each ride vehicle 12 may move or roll in a circumferential direction 50 about the Z axis 46 relative to the tower track 20. Such rolling motion may be clockwise and/or counterclockwise about the Z axis 46. The ride vehicle 12 may rotate 360° clockwise and/or counterclockwise about the Z axis 46. As such, the ride vehicle 12 may rotate through complete clockwise and counterclockwise barrel rolls (e.g., 360° rotation) and may rotate to any degree within the barrel roll. The circumferential motion 50 may occur during the duration of the ride to flip and/or roll the ride vehicle 12 and the riders upside down and may be triggered by interaction of the riders 14 of the ride vehicle 12 with other ride vehicles 12 and/or the ride environment, as discussed in greater detail with reference to FIGS. 5 and 6, and/or such circumferential motion 50 (e.g., rolling motion) may be programmed to occur through the control system. In some embodiments, the rolling motion in the direction 50 about the Z axis 46 may occur subsequent to or in combination with one or more different motions, such as the linear motion in the direction 48.

Additionally, each ride vehicle 12 may twist or tilt (e.g., pitch) in the direction 52 about the X axis 42. Such pitching motion 52 may cause the front of the ride vehicle 12 that is directed away from the tower track 20 and the interior wall 18 to tilt upward or downward, and thus may decrease or increase the angle $\alpha$ between the Y axis 44 and the Z axis 46. For example, the angle $\alpha$ may be 90° when the ride vehicle 12 is in the starting positon 56, and the front of the ride vehicle 12 may be tilted upward, thus decreasing the angle $\alpha$ by the degree of tilt. The front of the ride vehicle 12 may be tilted up to 90° up and 90° down about the X axis 42, and thus may be tilted up to 180° about the X axis 42. The upward and downward tilt (e.g., pitch) about the X axis 42 may occur during the duration of the ride and may be triggered by interaction of the riders 14 of the ride vehicle 12 with other ride vehicles 12 and/or the ride environment, as discussed in greater detail with reference to FIGS. 5 and 6, and/or such tilting may be programmed to occur through the control system. In some embodiments, the tilting (e.g., pitching) in the direction 52 about the X axis 42 may occur subsequent to or in combination with one or more different motions of the ride vehicle 12, such as the linear motion in the direction 48 and/or the circumferential rolling motion in the direction 50 about the Z axis 46.

Additionally, each ride vehicle 12 may twist or tilt (e.g., yaw) in the direction 54 about the Y axis 44. Such yawing motion 54 may cause the front of the ride vehicle 12 that is directed away from the tower track 20 and the interior wall 18 to tilt to either side (e.g., left or right), and thus may decrease or increase the angle β between the X axis 42 and the Z axis 46. For example, the angle β may be 90° when the ride vehicle 12 is in the starting position 56, and the front of the ride vehicle 12 may be tilted to the right, thus decreasing the angle β by the degree of tilt. The front of the ride vehicle 12 may be tilted up to 90° to the left and 90° to the right, and thus may be tilted up to 180° about the Y axis 44. The side to side tilt (e.g., yaw) about the Y axis 44 may occur during the duration of the ride and may be triggered by interaction of the riders 14 of the ride vehicle 12 with other ride vehicles 12 and/or the ride environment, as discussed in greater detail with reference to FIGS. 5 and 6, and/or such tilting may be programmed to occur through the control system. In some embodiments, the tilting (e.g., yawing) in the direction 54 about the Y axis 44 may occur subsequent to or in combination with one or more different motions of the ride vehicle 12, such as the linear motion in the direction 48, the circumferential rolling motion in the direction 50 about the Z axis 46, and/or the tilting (e.g., pitching) motion in the direction 52 about the X axis 42.

The motions or movements or the ride vehicles 12 described herein may be triggered by interaction of the riders 14 with the other ride vehicles 12, may be pre-programmed motions that occur at particular points during the operation of the interactive tower attraction 10, or a combination thereof.

Figure 4:
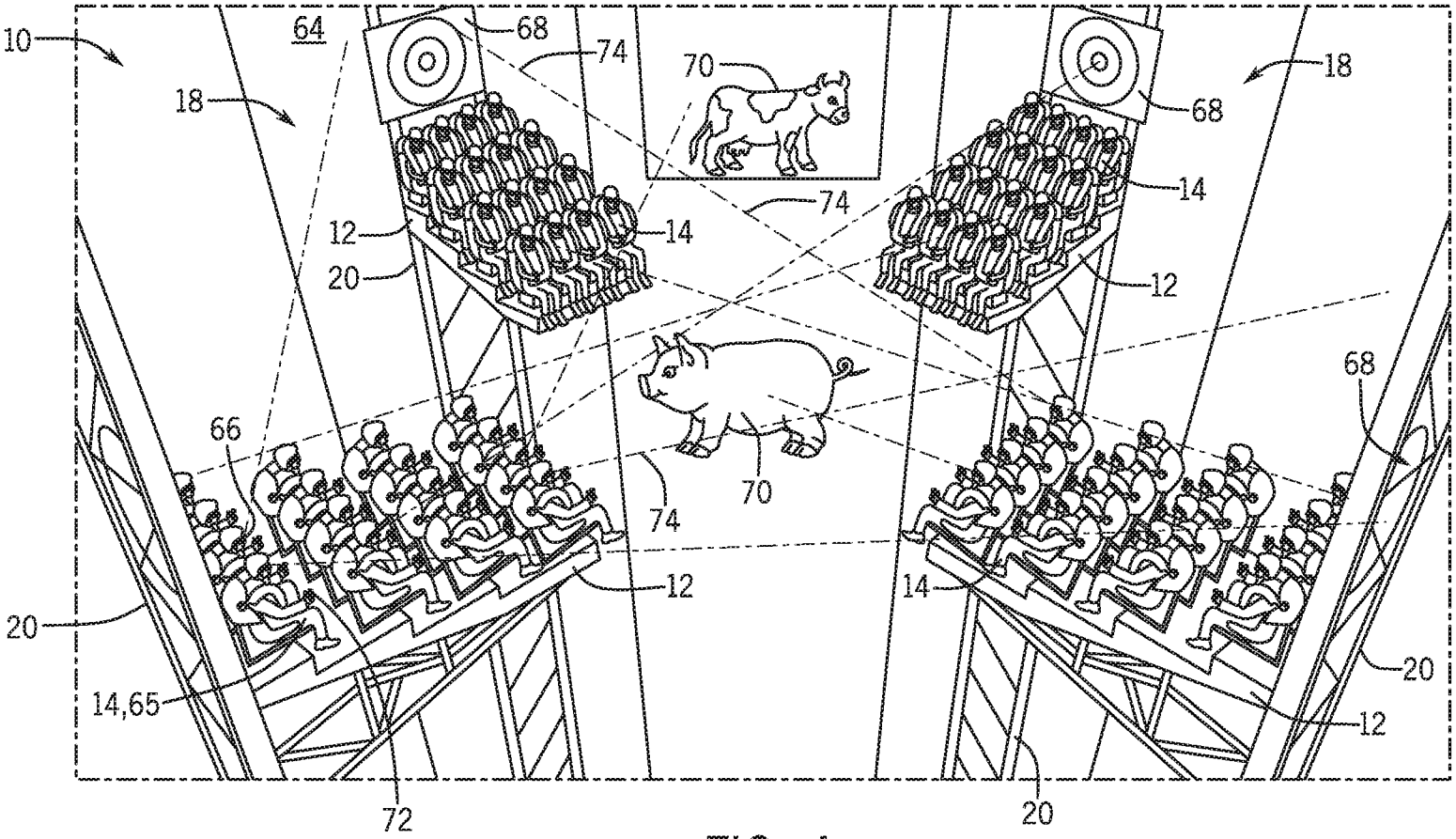
FIG. 4 is an interior perspective view of an embodiment of the interactive tower attraction of FIG. 1, in accordance with the present techniques.

To initiate motion patterns of one or more ride vehicles 12 during operation of the interactive tower attraction 10, the riders 14 may interact with the other ride vehicles 12 and/or the ride environment. Such interaction with the other ride vehicles 12 and/or riders 14 may provide signals that trigger the interactive tower attraction 10 to offer a different experience to each ride vehicle 12 and a different experience each time the interactive gaming attraction 10 is visited. In some embodiments, such interaction with the other ride vehicles 12 and/or the ride environment may further trigger other special effects, such as air blasts, cold wind, heat, water spray, smoke, fog, sound, and lighting effects, via the SFX system. FIG. 4 illustrates an interior perspective view of an embodiment of the interactive tower attraction 10 showing an augmented reality (AR) ride environment 64 that may be visualized and interacted with by the riders 14. Each of the riders 14 may wear a visualization device 66 that may enable the riders 14 to visualize the AR ride environment 64 during operation of the interactive tower attraction 10. As illustrated, FIG. 4 depicts the AR ride environment 64 as visualized from the perspective of a particular rider 65.

During the ride, each rider 14 may wear the visualization device 66 and may visualize the same AR ride environment 64 as visualized by the particular rider 65 from their perspective within the interactive tower attraction 10. The visualization devices 66 may be communicatively coupled to an AR system, as discussed in greater detail below with reference to FIG. 7, which may enable the AR images within the AR ride environment 64 to be visualized by the riders 14 through the visualization devices 66. In some embodiments, the riders 14 may purchase or otherwise be provided with the visualization device 66, such as electronic goggles, eyeglasses, or headsets, to be worn throughout the duration of the ride. The visualization device may be used to display the AR ride environment 64, such that the riders 14 may visualize and interact with elements of the AR ride environment 64. Although the ride environment of the interactive tower attraction 10 is discussed as being an AR ride environment, it should be understood that, in some embodiments, the elements of the ride environment may include projection elements or virtual reality (VR) elements alone, or in combination with AR elements.

Elements of the AR ride environment 64 may include targets 68 and/or characters 70, shown in the illustrated embodiment as animals. In some embodiments, the interactive tower attraction 10 may include a particular theme to which the elements (e.g., the targets 68 and the characters 70) of the AR ride environment 64 may be aligned. In some embodiments, the interactive tower attraction 10 may be part of a larger theme, such as a theme of an amusement park or section of an amusement part. As such, the characters 70 may be any type of characters or elements that fit the theme of the interactive tower attraction 10. The riders 14 may interact with the targets 68 and/or the characters 70 of the AR ride environment 64 using input devices 72, which may be weapons, selection tools, joy sticks, etc., and that receive user input and generate user input signals representative of the input. Each rider 14 may have an input device 72 associated with their seat of the ride vehicle 12. In the illustrated embodiment, the input devices 72 include devices used to shoot, by way of example, AR shells 74 at the targets 68 and/or the characters 70. In such embodiments, the AR shells 74 shot using the input devices 72 may be visualized by the riders 14 through the visualization devices 66 as part of the AR ride environment 64, creating a more interactive and immersive experience for the riders 14. Further, any explosions or other AR effects (e.g., feedback indicating a selection of the target 68) associated with hitting or otherwise interacting with the targets 68, the characters 70, or other elements of the AR ride experience may be visualized by the riders 14 through the visualization devices 66 as part of the AR ride environment, further enhancing the ride experience. In some embodiments, the input devices 72 may cause or control other interactions with the AR ride environment 64, such as cause movement of a mechanical arm, or other such interactions that may involve other types of simulated weapons.

The targets 68 of the AR ride environment 64 may be dedicated targets 68 for each ride vehicle 12 (and, for example, only visible to their associated ride vehicle 12) or may be global targets 68 that are available and/or visible to all of the ride vehicles 12. In certain embodiments, the AR environment may indicate through visual cues (e.g., particular colors) that a subset of the targets 68 are available to only a subset of the ride vehicles 12 for interaction. When the target 68 is available for interaction, the user input device 72 is capable of generating an interaction signal associated with a successful interaction. In certain embodiments, the attraction 10 may be configured to present targets 68 that, when viewed in the AR environment, are overlaid or adjacent to each ride vehicle 12 and that serve as visible targets 68 with which riders 14 in other ride vehicles 12 may interact to target competitor ride vehicles 12. For example, the riders 14 may shoot AR shells 74 at the targets 68 above other ride vehicles 12 to cause the associated ride vehicles 12 to move in a motion pattern as provided herein with reference to FIG. 3. In some embodiments, some or all of the riders 14 of each ride vehicle 12 may be considered a team. In such embodiments, each team may be indicated by a different color on the target 68 above their ride vehicle 12, or through any other indication, such as an AR image or text on the target 68 or the ride vehicle 12, or a color of the ride vehicle 12. The riders 14 of each team may shoot at, or otherwise interact with, the targets 68 of the other teams and may cumulatively cause movement of the other teams and ride vehicles 12, as discussed in greater detail with reference to FIG. 5. For example, the riders 14 of each team (e.g., ride vehicle 12) may accumulate points as a team against each other team by shooting the target 68 of each other team. Accumulating a particular threshold of points may trigger particular movements of the ride vehicle 12 against which the points were accumulated (e.g., the ride vehicle 12 associated with the target 68 that was hit). As another example, all of the riders 14 of other teams may accumulate points against a particular team as a whole, and movement of that particular ride vehicle 12 may be triggered when a particular point threshold is reached.

Further, in some embodiments, the input devices 72 may include devices for steering the ride vehicle 12 such that the ride vehicle 12 may be moved to dodge or avoid incoming AR shells 74 from hitting the target associated with the ride vehicle 12. As such, in some embodiments, one or more rider 14 of the ride vehicle 12 may control motion of the ride vehicle 12 to dodge incoming interaction from other ride vehicles 12, while the other riders 14 of the ride vehicle 12 may control input devices 72 that shoot or otherwise actively interact with the targets 68 of the other ride vehicles 12 and/or the character 70 of the AR ride environment 64. In such embodiments, control of the steering of the ride vehicle 12 may be transferred between riders 14 such that each rider 14 of the ride vehicle 12 may have a turn to steer and a turn to actively interact with the AR ride environment 64, such as shooting AR shells 74 at the targets 68 of the other ride vehicles 12.

Additionally or alternatively, in some embodiments, interacting with the elements of the AR ride environment 64 of the interactive tower attraction 10 may also include an individual element. For example, the visualization device 66 may depict arrows, or other indications, of elements of the AR ride environment 64 (e.g., targets 68, characters 70) to aim for and/or interact with. In such cases, hitting the indicated elements may earn individual points toward particular thresholds which may trigger movement of other ride vehicles 12 or the ride vehicle 12 which that particular rider 14 is in. As another example, a particular rider 14 may earn points for dodging incoming AR shells 74 that have been shot at their associated target 68 by other ride vehicles 12. In some embodiments, such individual interaction with the AR ride environment 64 may trigger movement of ride vehicles 12 in addition to the movement triggered by reaching team point thresholds. However, in some embodiments, the riders 14 may not be on teams, and individual interaction with the elements of the AR ride environment 64 may be the only factor for triggering movement of the ride vehicles 12.

Figure 6:
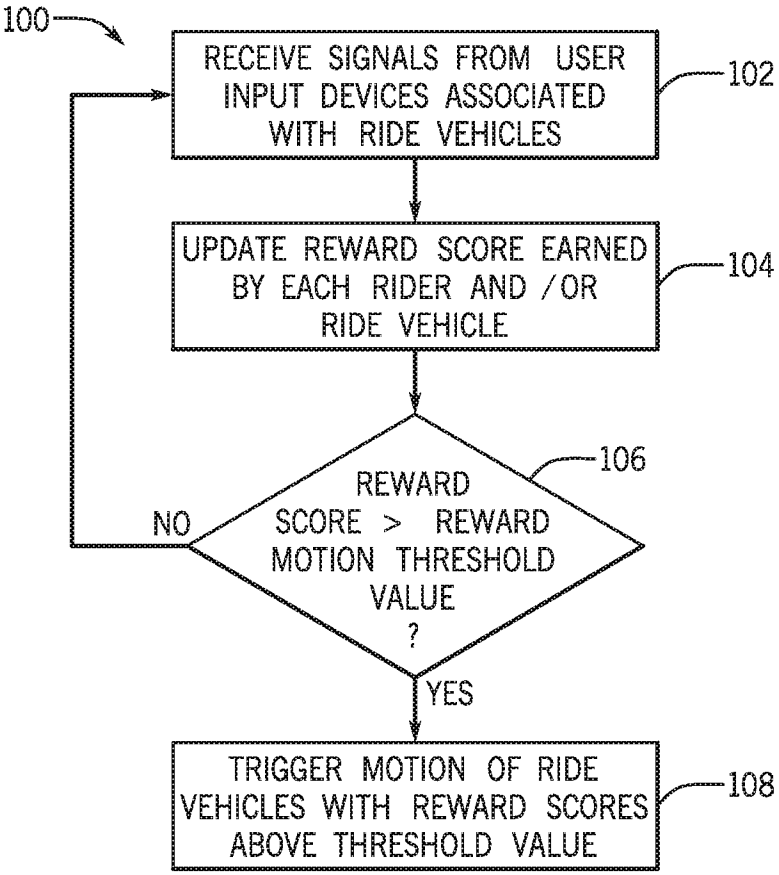
FIG. 6 is a flow chart of an embodiment of a method for triggering motion of your own vehicle of the interactive tower attraction of FIG. 4, in accordance with present techniques.
Figure 5:
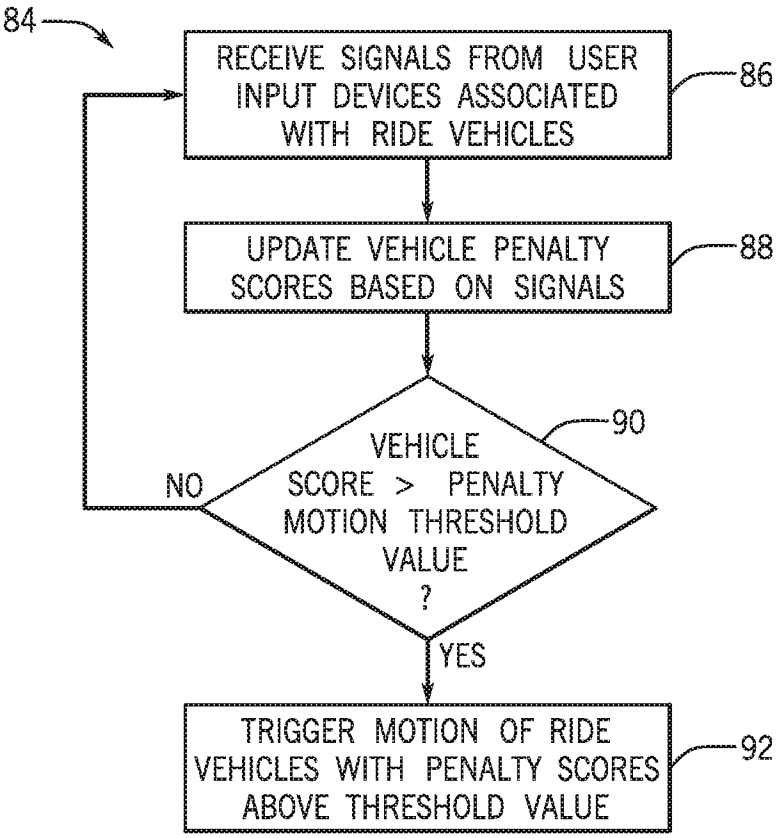
FIG. 5 is a flow chart of an embodiment of a method for triggering motion of another vehicle of the interactive tower attraction of FIG. 4, in accordance with present techniques.

Interaction with the targets 68 and the characters 70 of the AR ride environment 64 by the riders 14 of one ride vehicle 12 may trigger movement of the other ride vehicles 12 that the riders 14 are shooting at or otherwise interacting with, and may also trigger movement of the ride vehicle 12 which the riders 14 are in. To illustrate, FIG. 5 is a flow chart of an embodiment of a method 84 for triggering movement of another ride vehicle 12 of the interactive tower attraction 10 through interaction with the AR ride environment 64. Further, FIG. 6 illustrates a flow chart of an embodiment of a method for triggering movement of an individual ride vehicle 12 by the riders 14 in the individual ride vehicle 12.

Turning to FIG. 5, the method 84 may include riders 14 of the ride vehicles 12 interacting with the targets 68 of the AR ride environment 64 to increase a damage point total of the other ride vehicles 12 and/or teams. Based on interaction with the targets (via the user input devices 72), signals are received that are indicative of the interaction (block 86). A score for each vehicle 12 is updated based on the interaction. The score may be a total score, or may be a separate penalty score and/or reward score. In one embodiment, the score is a penalty score indicative of successful hits of targets 68 located at or near a particular ride vehicle 12. For example, when riders 14 of another ride vehicle 12 hit the target 68 of one of the ride vehicles, the signal is indicative of a successful interaction (a hit), and a damage point total with that ride vehicle 12 may increase. Each ride vehicle 12 and/or team may accumulate damage points for their target 68 being hit by riders 14 of other ride vehicles 12. In some embodiments, the damage point total may be indicated by a number, symbol, color, or other indication that may be visualized by the visualization devices 66 on or near the target 68, such that the riders 14 in other ride vehicles 12 may see how many damage points have been accumulated for each other ride vehicle 12. Further, in some embodiments, a damage point total (i.e., a penalty score) for the ride vehicle 12 which the rider 14 is in may be displayed to the rider 14 via the visualization device such that each rider 14 may see how many damage points have been accumulated against their ride vehicle 12.

Next, a control system of the interactive tower attraction 10 and/or an AR system may calculate the damage points accumulated against each ride vehicle 12 or team based on the signals (block 88). The control system may then compare the damage points accumulated against each ride vehicle 12 to a motion threshold value (block 90). If the control system determines that the damage points accumulated against the ride vehicles 12 are not greater than the motion threshold value, the method 84 may begin again at block 86 with riders 14 interacting with the targets 68. If the control system determines that the damage points accumulated against one of the ride vehicles 12 is greater than the motion threshold value, the control system may trigger motion of that ride vehicle 12 with the penalty score associated with penalty motion (block 92). For example, if the control system determines that the damage points accumulated against a particular ride vehicle 12 is greater than the motion threshold value, because the riders 14 of the other ride vehicles 12 have hit the target 68 of that ride vehicle 12 enough times, the control system may trigger a barrel roll motion in the direction 50, or any of the other motions previously discussed with reference to FIG. 3.

In some embodiments, the accumulated damage points may clear each time the motion threshold value is exceeded. There may be a particular motion pattern that is triggered each time the motion threshold is exceeded, or different motion patterns may be triggered randomly each time the motion threshold is exceeded. In other embodiments, there may be multiple motion thresholds, each corresponding to a different triggered motion pattern. In such embodiments, the motion threshold values may increase in value such that different motion patterns are triggered as the damage points accumulated against the ride vehicles 12 increases throughout the duration of the ride. Each increasing motion threshold value may correspond to a particular motion pattern, or the control system may randomly assign motion patterns to each motion threshold value. In some embodiments, the motions may be triggered in the same order for each ride vehicle 12 and/or correspond to the same increasing motion threshold value for each ride vehicle 12. However, in other embodiments, different motions may be triggered for each exceeded motion threshold between the ride vehicles 12. Triggering of motions of the ride vehicles 12 when motion threshold values are exceeded may increase the variation of ride experiences for the riders 14.

It should be understood that the method 84 may be an iterative or repeating process that is performed throughout the duration of the ride to trigger motion of the ride vehicles 12. As such, the control system may continuously calculate damage point totals for the ride vehicles 12 and determine whether the motion threshold value has been exceeded to trigger motion of the ride vehicles 12.

Further, the riders 14 may trigger motion of their own ride vehicle 12. To illustrate, FIG. 6 is a flow chart of an embodiment of a method 100 for triggering motion of the ride vehicle 12 carrying the rider 14. The method 100 may include riders 14 actively and/or passively interacting with the targets 68 associated with other ride vehicles 12 and/or the characters 70 of the AR ride environment 64 to generate signals indicative of successful interactions to earn reward points individually and/or as a team (e.g., the ride vehicle 12) (block 102). For example, when the riders 14 of a ride vehicle 12 actively shoot AR shells 74 that hit the targets 68 of other ride vehicles 12 or the characters 70, the shooting riders 14 earn reward points individually and/or as a team for their ride vehicle 12. As another example, if one or more riders 14 of a ride vehicle 12 steers the ride vehicle 12 using the input device 72, those riders 14 may passively earn reward points individually and/or for their team (e.g., ride vehicle 12) by dodging incoming AR shells 74 such that they do not hit the target 68 of the ride vehicle 12. In some embodiments, an individual and/or team reward point total may be displayed to the riders 14 via the visualization device such that each rider 14 may see how many reward points they or their team has accumulated.

Next, the control system of the interactive tower attraction 10 and/or the AR system may calculate the amount of reward points each rider 14 and/or each team or ride vehicle 12 has earned based on the signals (block 104). The control system may then compare the reward points earned by each rider 14 and/or each ride vehicle 12 with a reward motion threshold value (block 106). If the control system determines that the reward points earned by riders 14 or the ride vehicles 12 are not greater than the reward motion threshold value, the method 100 may begin again at block 102 with riders actively and/or passively interacting with the elements of the AR ride environment 64. If the control system determines that the reward points earned by a rider 14 or a ride vehicle 12 is greater than the reward motion threshold value, the control system may trigger motion of that ride vehicle 12 or the ride vehicle 12 in which that rider 14 is seated. For example, if the control system determines that one of the ride vehicles 12 has earned an amount of reward points that exceeds the reward motion threshold value, because the riders 14 of the ride vehicle 12 have successfully hit other targets 68 and/or characters 70 and/or have successfully dodged incoming AR shells 74 from other ride vehicles 12, the control system may trigger motion in an upward direction 48, or any of the other motions previously discussed with reference to FIG. 3. In some embodiments, such motion triggered by exceeding the reward motion threshold may positon the ride vehicle 12 in a positon that increases the difficulty for riders 14 of other ride vehicles 12 to hit the target 68 of the ride vehicle 12, and/or may increase the variable ride experience.

The earned reward points may clear after each time the reward motion threshold value is exceeded. There may be a particular order that motion patterns are triggered each time the reward motion threshold is exceeded, or different motion patterns discussed previously may be triggered randomly each time the reward motion threshold is exceeded. In other embodiments, there may be multiple reward motion thresholds, each corresponding to a different triggered motion or combination of motions. In such embodiments, the reward motion threshold values may increase in value such that different motions or combinations of motions are triggered as the earned reward points for the riders 14 and/or the ride vehicles 12 increase throughout the duration of the ride. Each increasing reward motion threshold value may correspond to a motion pattern, or the control system may randomly assign motion patterns to each reward motion threshold value. In some embodiments, the motions may be triggered in the same order for each rider 14 or ride vehicle 12 and/or correspond to the same increasing reward motion threshold value for each rider 14 or ride vehicle 12. However, in other embodiments, different motions may be triggered for each exceeded reward motion threshold between the riders 14 and/or the ride vehicles 12. Triggering of motions of the ride vehicles 12 when reward motion threshold values are exceeded may increase the variation of ride experiences for the riders 14.

It should be understood that the method 100 may be an iterative or repeating process that is performed throughout the duration of the ride to trigger motion of the ride vehicles 12. As such, the control system may be continuously calculating earned reward point totals for the riders 14 and/or the ride vehicles 12 and determining whether the reward motion threshold value has been exceeded to trigger motion of the ride vehicles 12. Further, the method 84 and the method 100 may be performed simultaneously during operation of the interactive tower attraction 10 to trigger motion of the ride vehicles 12 and to generate a total combined score for each ride vehicle 12. That is, the total score may be a reward score with a penalty score subtracted. In some embodiments, the control system may trigger precarious tilting or leaning of the ride vehicles 12 during the method 84 and/or the method 100 as the accumulated damage point totals and/or the earned reward point totals near the motion threshold or the reward motion threshold, thus creating a more suspenseful and entertaining ride experience.

Figure 7:
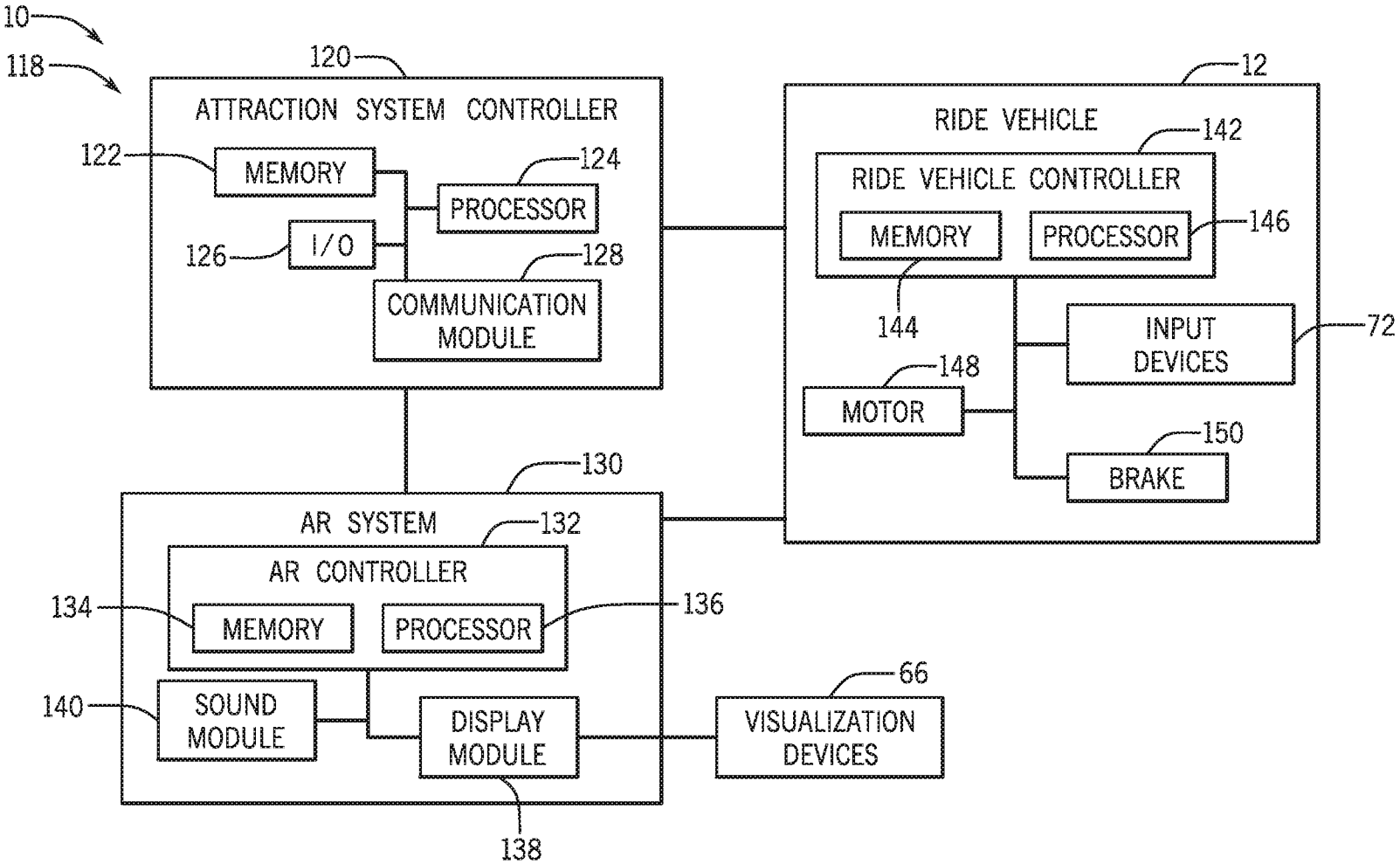
FIG. 7 is a block diagram of an embodiment of a control system that may be employed within the interactive tower attraction of FIG. 4, in accordance with the present techniques.

FIG. 7 illustrates an embodiment of a control system 118 that may be employed within the interactive tower attraction 10 to control movement of the ride vehicles and the AR ride environment 64 displayed to the riders 14. The control system 118 may include an attraction system controller 120 that may be communicatively coupled to the other elements of the interactive tower attraction 10. The attraction system controller 120 may include a memory 122 and a processor 124. In some embodiments, the memory 122 may include one or more tangible, non-transitory, computer-readable media that store instructions executable by the processor 124 and/or data to be processed by the processor 124. For example, the memory 122 may include random access memory (RAM), read only memory (ROM), rewritable non-volatile memory such as flash memory, hard drives, optical discs, and/or the like. Additionally, the processor 124 may include one or more general purpose microprocessors, one or more application specific processors (ASICs), one or more field programmable logic arrays (FPGAs), or any combination thereof. Further, the memory 122 may store instructions executable by the processor 124 to perform the methods and control actions described herein for the interactive tower attraction 10.

The attraction system controller 120 may further include one or more input/output (I/O) devices 126 that may facilitate communication between the attraction system controller 120 and a user (e.g., operator). For example, the I/O devices may include a button, a keyboard, a mouse, a trackpad, and/or the like to enable user interaction with the attraction system controller 120 and the control system 118. Additionally, the I/O devices 126 may include an electronic display to facilitate providing a visual representation of information, for example, via a graphical user interface (GUI), and application interface, text, a still image, and/or video content. Further, the attraction system controller 120 may be configured to communicate with other elements of the interactive tower attraction 10 over wired or wireless communication paths. In some embodiments, the attractions system controller 120 may include a communication module 128 that may facilitate transmission of information between the attraction system controller 120 and the other elements of the control system 118 and the interactive tower attraction 10, such as an augmented reality (AR) system 130.

The AR system 130 may be communicatively coupled to the attraction system controller 120. The AR system 130 may enable display of the AR ride environment 64, including the targets 68, the characters 70, and the AR shells 74, displayed to the riders 14 of the interactive tower attraction 10 via the visualization devices 66. The AR system 130 may include an AR controller 132 that may be configured to cause display of the elements of the AR ride environment 64. The AR controller 132 may include a memory 134 and a processor 136. In some embodiments, the memory 134 may include one or more tangible, non-transitory, computer-readable media that store instructions executable by the processor 136 and/or data to be processed by the processor 136. For example, the memory 134 may include random access memory (RAM), read only memory (ROM), rewritable non-volatile memory such as flash memory, hard drives, optical discs, and/or the like. Additionally, the processor 136 may include one or more general purpose microprocessors, one or more application specific processors (ASICs), one or more field programmable logic arrays (FPGAs), or any combination thereof.

The AR system 130 may further include a display module 138 and a sound module 140. The display module 138 may be communicatively coupled to the AR controller 132 and the visualization devices 66 worn by the riders 14. The display module 138 may generate the AR ride environment 64 and cause display of the elements of the AR ride environment 64 via the visualization devices 66. Further, the display module 138 may be communicatively coupled to the sound module 140 that may cause production of the sounds corresponding to the displayed AR ride environment 64. The processor 136 of the AR controller 132 may be configured to determine the correct viewing angle for each rider 14 of the interactive tower attraction 10 and transmit signals indicative of the viewing angles to the display module 138. Thus, the elements of the AR ride environment 64 may be displayed to each rider 14 as it should be viewed from their position of the interactive tower attraction 10. Further, the processor 136 of the AR controller 132 and/or the processor 124 of the attraction system controller 120 may be configured to calculate the damage points accumulated and the reward points earned, as previously discussed with reference to FIGS. 5 and 6. The AR controller 132 may be configured to store in the memory 134 a model of the attraction 10 based on image data, location data, and/or other data relating to the attraction 10 and upon which the AR images are overlaid.

The attraction system controller 120 and the AR system controller 132 may each be communicatively coupled to a ride vehicle controller 142 of each ride vehicle 12. Each ride vehicle 12 may include the ride vehicle controller 142. The ride vehicle controller 142 may include a memory 144 and a processor 146. In some embodiments, the memory 144 may include one or more tangible, non-transitory, computer-readable media that store instructions executable by the processor 146 and/or data to be processed by the processor 146. For example, the memory 144 may include random access memory (RAM), read only memory (ROM), rewritable non-volatile memory such as flash memory, hard drives, optical discs, and/or the like. Additionally, the processor 146 may include one or more general purpose microprocessors, one or more application specific processors (ASICs), one or more field programmable logic arrays (FPGAs), or any combination thereof.

In some embodiments, the ride vehicle controller 142 may receive signals (e.g., inputs, feedback, etc.) from the input devices 72 associated with that particular ride vehicle 12 and process the received signals to control operation of the respective ride vehicle 12. For example, if the input devices 72 include one or more devices used to steer or dodge, the ride vehicle controller 142 may process the signals from those input devices to control certain movements of the ride vehicle. Further, the ride vehicle controller 142 may send the signals received from the input devices 72 to the AR controller 132 and/or the attraction system controller 120, which may use the received signals to calculate the accumulated damage points and/or the earned reward points for the respective rider 14 and/or the respective ride vehicle 12. The attraction system controller 120 or the AR controller 132 may calculate the accumulated damage points and the earned reward points and may compare them to the respective motion threshold value or the reward motion threshold value. Alternatively, such comparison may be performed by the ride vehicle controller 142. Further, signals received from the input devices 72 may be used by the AR system 130 to modify the displayed AR ride environment 64 based on the received inputs.

The motion threshold value(s) and the reward threshold value(s) may be stored in the memory 122, the memory 134, and/or the memory 144. Further, the motions triggered by exceeding each motion threshold value or each reward motion threshold value may also be stored in the memory 122, the memory 134, and/or the memory 144. In some embodiments, the triggered motions may be random each time the motion threshold or the reward motion threshold is exceeded. In such embodiments, the processor 124, the processor 136, or the processor 146 may randomly select a motion, from the motions described above with reference to FIG. 3, each time a threshold is exceeded. However, in some embodiments, particular motions or combinations of motions may correspond to each threshold exceeded.

To provide the movement to the ride vehicles 12 to perform the motions triggered when the motion threshold and/or the reward motion threshold is exceeded, and to lift the ride vehicles 12 to the starting position 56 at the beginning of the ride, the ride vehicles 12 may each include a motor 148 and a brake 150. When the attraction system controller 120 or the AR controller 132 determines that one of the threshold values has been exceeded, a signal to trigger one of the associated motions may be sent to the respective ride vehicle controller 142. The ride vehicle controller 142 may then send a signal indicative of the triggered motion to the motor 148 and the brake 150 of the ride vehicle 12 to produce the triggered motion. It should be understood that the processes described as being performed by a particular controller of the control system 118 may additionally or alternatively be performed by any of the other controllers of the control system 118 to display the AR ride environment 64 and produce the motions of the ride vehicles 12 creating an varied, competitive, and interactive experience for the riders 14.

Figure 8:
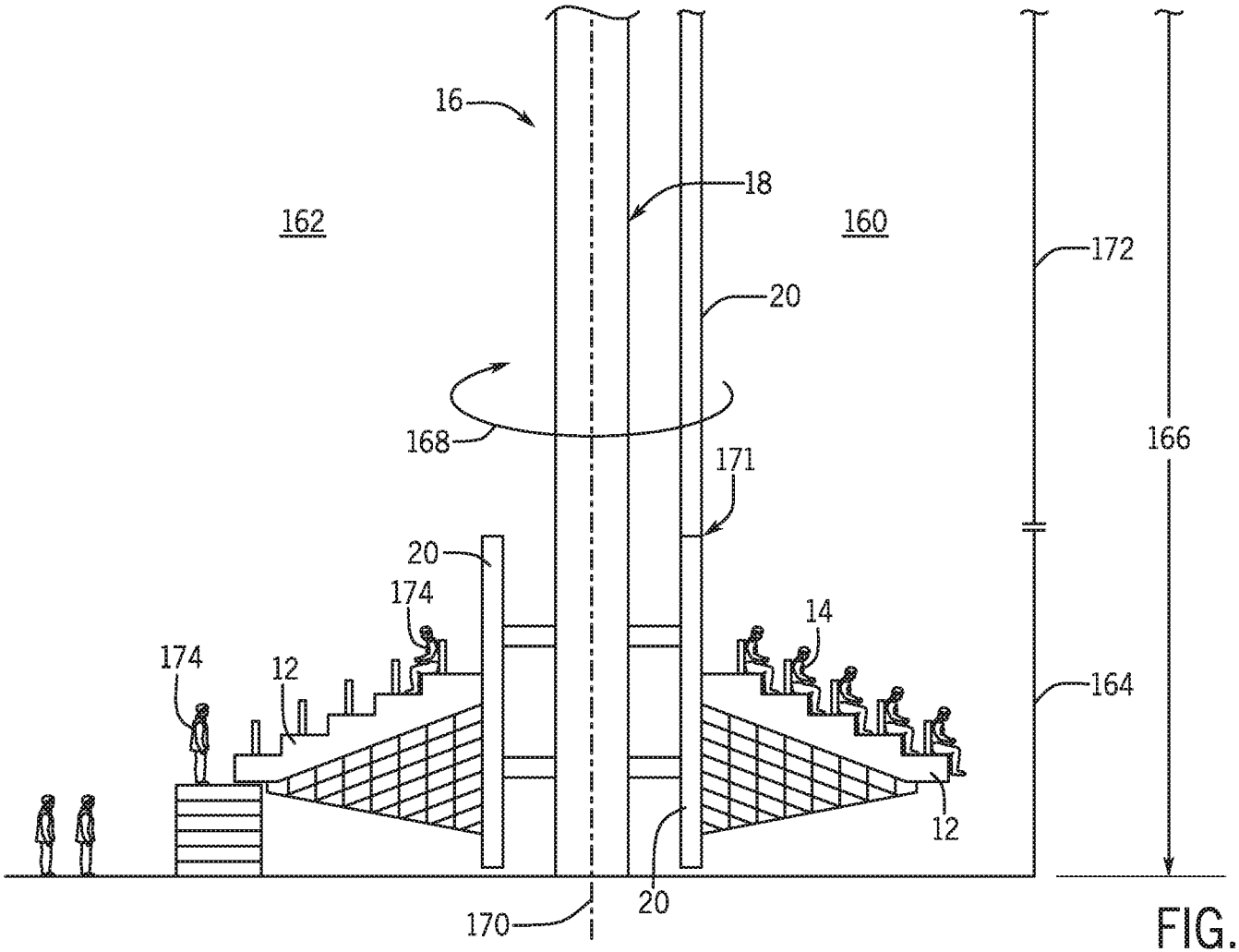
FIG. 8 is a perspective view of an embodiment of a loading and unloading system of the interactive tower attraction of FIG. 1, in accordance with present techniques.

In order to ride the interactive tower attraction 10, the riders 14 must load into the ride vehicles 12. In some embodiments, a traditional method of loading and unloading of the ride vehicles 12 may be used, such as entering the tower 16 on foot and loading and unloading the ride vehicles 12 within the tower 16. However, FIG. 8 illustrates a system of loading and unloading the ride vehicles 12 that may enable a greater throughput of riders 14 and/or may enable extension of the ride time of the interactive tower attraction 10 by decreasing the time required to load and unload the riders 14. FIG. 8 shows a cross-sectional view of one wall of the tower 16.

As illustrated, the interactive tower attraction 10 may include two ride vehicles 12 disposed on opposite sides of each wall of the tower 16, such that one ride vehicle 12 is disposed inside 160 of the tower 16 while the other ride vehicle 12 is disposed outside 162 of the tower 16 at a particular time. As such, there may be an inner ring of ride vehicles 12 inside 160 the tower, while another ring of ride vehicles 12 may be outside 162 of the tower. In some embodiments, a lower portion 164 of the length 166 of the tower track 20 and the interior wall 18 may be rotatable in the direction 168 about a central vertical axis 170 of the wall 18. The lower portions 164 of the tower track 20 and the interior wall 18 may be rotatable 180° or 360° to enable one ride vehicle 12 to enable each ride vehicle 12 to be rotated from inside 160 the tower 16 to outside 162 the tower, and back again. Each ride vehicle 12 disposed about each wall of the tower 16 may be coupled to a section of the tower track 20 corresponding to the lower portion 164. As such, when the lower portions 164 of the tower track 20 and the wall 18 are rotated in the direction 168, the lower portion 164 of the tower track 20 that is currently disposed inside 160 of the tower 16 may be coupled via a track switch 171 to an upper portion 172 of the tower track 20 to create the whole length 166 of the tower track 20 for operation of the interactive tower attraction 10. In some embodiments, the upper portion 172 may be larger than the lower portion 164.

With this configuration, while the riders 14 inside 160 of the tower are riding the interactive tower attraction 10, new riders 174 may be loading the ride vehicles currently outside 162 of the tower. Therefore, when the current interactive tower attraction 10 ride comes to an end, the ride vehicles 12 may be lowered along the tower track 20 to the lower portion 164 where the lower portion 164 of the tower track 20 may be decoupled from the upper portion 172 of the tower track 20 via the track switch 171. The lower portion 164 of the interior wall 18 and the tower track 20 may be rotated in the direction 168 about the axis 170 to transfer the ride vehicle 12 that just finished the ride from inside 160 to outside 162 the tower. Such rotation will simultaneously transfer the newly boarded ride vehicle 12 that was outside 162 of the tower 16 to inside 160 of the tower 16 to begin their ride. The riders 14 that just finished their ride may then unload from the ride vehicles 12 outside 162 of the tower 16 and those ride vehicles 12 may be loaded with new riders 174. Therefore, the loading and unloading system illustrated in FIG. 8 may increase the efficiency and loading and unloading and may decrease time between rides of the interactive tower attraction 10 and, thus, may increase the throughput of riders 14 and may increase ride time of the interactive tower attraction 10. In some embodiments, more than two ride vehicles 12 and positions may be employed (e.g., loading vehicle, unloading vehicle, active ride vehicle, each in a respective location about an axis or rotation).

Figure 9:
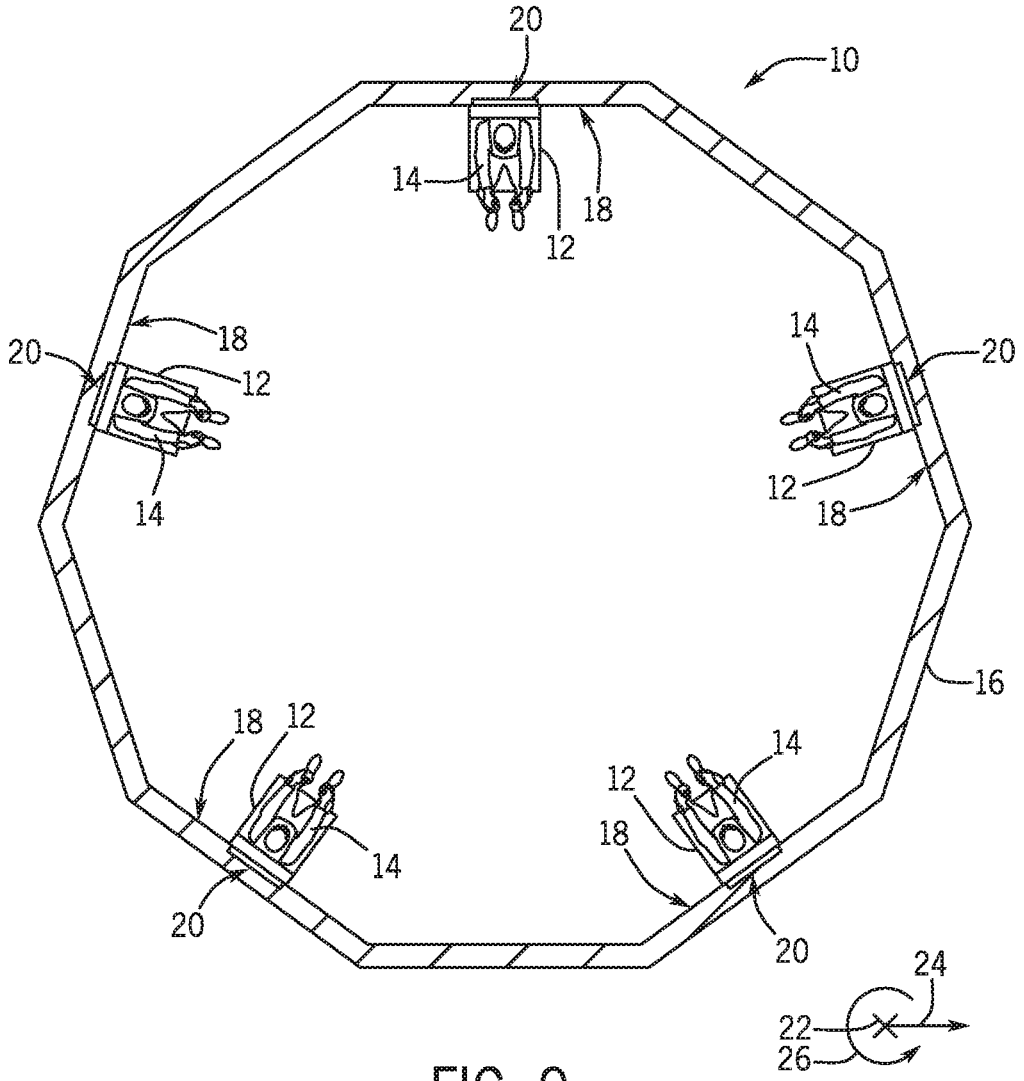
FIG. 9 is a cross-sectional top view of an embodiment of the interactive tower attraction employing single passenger vehicles, in accordance with present techniques.

While the ride vehicles 12 are depicted as holding multiple riders 14, as previously discussed, in some embodiments, the ride vehicles 12 may be single rider ride vehicles 12. To illustrate, FIG. 9 shows a cross-sectional top view of an embodiment of the interactive tower attraction 10 having multiple single passenger ride vehicles 12 disposed within the tower 16. The interactive tower attraction 10 includes multiple single passenger ride vehicles 12 each coupled to a corresponding tower track 20 and positioned adjacent to separate interior walls 18 of the tower 16. As such, the ride vehicles 12 of the interactive tower attraction 10 may be disposed circumferentially 26 about the interior of the tower 16. In the illustrated embodiment, the ride vehicles 12 are positioned adjacent to half of the interior walls 18 of the tower 16, in such a configuration that there is a ride vehicle 12 adjacent to every other interior wall 18. In other embodiments, any quantity of the ride vehicles 12 may each be positioned adjacent to a corresponding quantity of interior walls 18 in any position that may enable the riders 14 to interact with the ride environment and/or the other ride vehicles 12 of the interactive tower attraction 10. In some embodiments, with single passenger ride vehicles 12, each rider 14 may interact with the AR ride environment 64 and the other riders 14 to earn reward points and accumulate damage points individually. However, in other single passenger ride vehicle 12 embodiments, the riders 14 may be on teams indicated by colors or other indications, as discussed above with reference to FIG. 4.

While only certain features of present embodiments have been illustrated and described herein, many modifications and changes will occur to those skilled in the art. It is, therefore, to be understood that the appended claims are intended to cover all such modifications and changes that fall within the true spirit of the disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A ride attraction system, comprising:

a first tower track and a second tower track;

a first ride vehicle coupled to the first tower track and comprising at least one seat, wherein the first ride vehicle is configured to move with two or more degrees of freedom relative to the first tower track;

a second ride vehicle coupled to the second tower track and comprising at least one seat, wherein the second ride vehicle is configured to move with two or more degrees of freedom relative to the second tower track;

a first user input device coupled to the first ride vehicle and a second user input device coupled to the second ride vehicle;

an image system configured to display a ride environment, wherein the first user input device and the second user input device are configured to interact with elements of the displayed ride environment; and a controller communicatively coupled to the first ride vehicle, the second ride vehicle, and the image system, wherein the controller is configured to control movement of the first ride vehicle and the second ride vehicle based on signals output in response to interactions of the first user input device and the second user input device with the elements of the displayed ride environment.

2. The ride attraction system of claim 1, wherein interactions of the first user input device with a first subset of the elements of the displayed ride environment are configured to cause the first ride vehicle to move in a first motion pattern, wherein interactions of the first user input device with a second subset of the elements of the displayed ride environment are configured to cause the first ride vehicle to move in a second motion pattern, and wherein interactions of the second input user device with the elements of the displayed ride environment are configured to cause the first ride vehicle to move in a third motion pattern, or some combination thereof.

3. The ride attraction system of claim 2, wherein the first motion pattern is different than the second motion pattern.

4. The ride attraction system of claim 2, wherein the first motion pattern is configured to move the first ride vehicle in a first direction along the first tower track, and the third motion pattern is configured to move the first ride vehicle in a second direction, opposite the first direction, along the first tower track.

5. The ride attraction system of claim 2, wherein interactions of the first user input device with the second subset of the elements are configured to cause the second ride vehicle to move in a fourth motion pattern.

6. The ride attraction system of claim 5, wherein the third motion pattern and the fourth motion pattern are configured to cause the first ride vehicle and the second ride vehicle, respectively, to pitch, yaw, roll, or some combination thereof.

7. The ride attraction system of claim 5, wherein the first ride vehicle moves in the first motion pattern while the second ride vehicle moves in the fourth motion pattern.

8. The ride attraction system of claim 2, wherein the first motion pattern and the second motion pattern comprise at least one of a pitch, yaw or roll motion relative to the first tower track.

9. The ride attraction system of claim 1, wherein the first ride vehicle comprises a platform to which the at least one seat is coupled and a support frame coupled to the platform and to the first tower track, wherein motion of the platform causes the at least one seat to pitch, yaw, or roll.

10. The ride attraction system of claim 1, wherein the image system comprises a projection system configured to project the elements of the displayed ride environment onto portions of the ride attraction system, and wherein the elements of the displayed ride environment comprise images of characters, targets, or a combination thereof.

11. The ride attraction system of claim 1, wherein the image system comprises a plurality of visualization devices configured to display the ride environment to one or more riders individually, and wherein the plurality of visualization devices comprise an augmented reality (AR) system, a virtual reality (VR) system, or a combination thereof.

12. The ride attraction system of claim 1, wherein a first subset of the elements are associated with the first ride vehicle and a second subset of the elements of the displayed ride environment are associated with the second ride vehicle.

13. The ride attraction system of claim 1, wherein one or both of the first user input device or the second user input device comprises a shooting device configured to virtually shoot at the elements of the displayed ride environment, wherein hitting the elements of the ride environment earns points.

14. The ride attraction system of claim 1, wherein the first user input device comprises a steering device, wherein the steering device is configured to output a steering signal to the controller, wherein the controller is configured to cause the first ride vehicle to pitch, yaw, roll, move axially along the first tower track, or some combination thereof, based on the steering signal, and wherein dodging incoming interactions earns points.

15. A ride attraction system, comprising:

a plurality of tower tracks;

a plurality of ride vehicles, wherein each ride vehicle of the plurality of ride vehicles comprises a stepped platform configured to provide tiered seating and wherein each ride vehicle of the plurality of ride vehicles is coupled to a respective tower track of the plurality of tower tracks and configured to move in one or more degrees of freedom relative to the respective tower track of the plurality of tower tracks and independently of other ride vehicles of the plurality of ride vehicles;

at least one user input device associated with each ride vehicle of the plurality of ride vehicles, wherein each user input device of the at least one user input device is configured to receive user inputs and provide user input signals; and a controller configured to receive the user input signals from the at least one user input device and to provide instructions to a ride vehicle controller of an individual ride vehicle of the plurality of ride vehicles to execute a motion pattern of the individual ride vehicle based on the received user input signals, wherein the motion pattern of the individual ride vehicle comprises movement along an axis of the respective tower track, wherein the individual ride vehicle moves independently of other ride vehicles of the plurality of ride vehicles while executing the motion pattern.

16. The ride attraction system of claim 15, comprising an image system, the image system comprising an augmented reality (AR) system, a virtual reality (VR) system, a projection system, or a combination thereof, and wherein the controller is configured to receive the user input signals as indicative of user interaction with the image system via the at least one user input device.

17. The ride attraction system of claim 15, wherein the controller is configured to determine a point total accumulated by each ride vehicle of the plurality of ride vehicles, wherein the point total is based on interactions between the at least one user input device associated with each ride vehicle of the plurality of ride vehicles and elements of a displayed ride environment, wherein the controller is configured to initiate the motion pattern of the individual ride vehicle based on a determination that an accumulated point total of the individual ride vehicle is greater or less than a point threshold.

18. The ride attraction system of claim 17, wherein interactions between the at least one user input device associated with each ride vehicle of the plurality of ride vehicles and the elements of the displayed ride environment are configured to trigger one or more special effects, wherein the one or more special effects comprise air blasts, cold wind, heat, water spray, smoke, fog, sound, lighting effects, or some combination thereof.

19. A method, comprising;

receiving user input signals, at a controller, from a user input device associated with a ride vehicle of a plurality of ride vehicles;

determining, via the controller, a respective point total accumulated by the ride vehicle of the plurality of ride vehicles based on the received user input signals; and triggering, via the controller, a first motion pattern of the ride vehicle of the plurality of ride vehicles based on a first point total accumulated by the ride vehicle of the plurality of ride vehicles reaching a first point threshold, wherein the first motion pattern is configured to cause the ride vehicle to move in an axial direction along a tower track, pitch, yaw, roll, or some combination thereof, and triggering, via the controller, a second motion pattern of the ride vehicle of the plurality of ride vehicles based on a second point total of the ride vehicle of the plurality of ride vehicles reaching a second point threshold.

20. The method of claim 19, wherein determining the first point total or the second point total accumulated by the ride vehicle is based at least in part on additional user input signals from user input devices of other ride vehicles of the plurality of ride vehicles.

* * * * *